US005518299A

United States Patent [19]

Adamczyk et al.

[11] Patent Number: 5,518,299

[45] Date of Patent: May 21, 1996

[54] DUST CONTROL APPARATUS FOR LONGWALL MINING MACHINERY

[75] Inventors: Mike S. Adamczyk; Jay D. Armburger, both of Franklin; Robert P. Aaron, Jr., Marble, all of Pa.

[73] Assignee: Joy MM Delaware, Inc., Wilmington, Del.

[21] Appl. No.: 351,716

[22] Filed: Dec. 8, 1994

[51] Int. Cl.[6] ..... E21C 35/22

[52] U.S. Cl. ..... 299/12; 299/43

[58] Field of Search ..... 299/12, 43, 64

[56] References Cited

U.S. PATENT DOCUMENTS

| | | | |
|---|---|---|---|
| 3,700,284 | 10/1972 | Agnew | 299/12 X |
| 4,315,658 | 2/1982 | French et al. | 299/12 |
| 4,351,567 | 9/1982 | Gillingham | 299/12 X |
| 4,380,353 | 4/1983 | Campbell et al. | 299/12 |
| 5,219,208 | 6/1993 | Liao et al. | 299/12 |
| 5,265,941 | 11/1993 | Marteney | 299/12 |

*Primary Examiner*—David J. Bagnell
*Attorney, Agent, or Firm*—Kirkpatrick & Lockhart

[57] ABSTRACT

Apparatus for substantially removing dust created during mining by a mining machine, which has an elongated mobile frame and a laterally extending rotating drum at each end thereof for shearing material to be won from a mine face, from air moving along the mine face. A preferred form of the apparatus includes a housing duct that is attached to the mobile frame between the rotating drums. The housing duct has an inlet and an outlet and is arranged such that the outlet is adjacent the side of the frame that faces the mine face. A screen is supported within the housing between the inlet and outlet and a fan is provided to induce dust laden air to flow into the housing and through the screen. An air deflection barrier and at least one venturi spray are attached to the frame for deflecting dust laden air into the housing inlet. At least one spray nozzle is arranged within the housing to spray a liquid from a liquid source onto the screen such that, when the dust laden air passes through the screen, it is substantially entrained in the liquid and discharged through the outlet by the fan.

8 Claims, 7 Drawing Sheets

DUST CONTROL APPARATUS FOR LONGWALL MINING MACHINERY

BACKGROUND OF THE INVENTION

1. Field of the Invention

The present invention relates to dust abatement and filtering apparatus and, more particularly, is directed to dust control apparatus for use in connection with mining machines adapted for mining material from "longwalls" in underground mining operations.

2. Description of the Invention Background

A variety of different apparatuses exist for mining coal and other materials from underground seams. One apparatus which is commonly used in underground mining operations comprises a continuous mining machine which includes a rotatable cutting drum that is mounted on the front end of the mining machine. As the mining machine is advanced into the seam, the cutting drum dislodges or "wins" the coal from the seam. In most continuous miners of this type, the won material is conveyed rearwardly of the cutter drum by a longitudinally extending conveyor that may discharge into shuttle cars or other mobile conveying apparatuses to transport the won material from the mine face. The continuous mining machine continuously advances into the seam and, as the material is won therefrom, an entry or tunnel is formed therein.

Another type of continuous mining machine is used in instances wherein extended portions or longwalls of seam are desired to be mined. Such longwalls may, depending upon the seam configuration, extend for distances of 300–1200 feet. It is standard practice in this type of mining to mine parallel entries into the seam to be mined and connect those entries with one or more primary passages. Such arrangement defines the longwall pillar(s) to be mined. The roof of the primary passages are usually supported by movable roof supports during the mining of the exposed "face" of the longwall pillar.

Conventional longwall mining techniques employ a mining machine that is known in the industry as a longwall shearer. A longwall shearer typically has an elongated mobile frame that is supported on floor-mounted tracks that are adjacent and substantially parallel to the mine face. Rotary driven toothed drums are operably supported on arms on each end of the elongated frame for winning the coal as the frame passes back and forth before the mine face. The won material falls into a face conveyor that is usually attached to the floor-mounted tracks and extends parallel to the longwall face. The face conveyor discharges the material onto other conveying apparatuses to transport the material from the seam. As the mine face recedes, the conveyor and track assembly is advanced forward to enable the shearer to continue mining.

Both of the continuous mining machines discussed above generate dust during the mining process. Dust formation has long been recognized as a serious hazard in underground mining operations and a number of different filtering apparatuses have been developed to control the permeation of airborne dust around the portions of the mining machine where the operators and support personnel are located.

One type of dust control apparatus that has been developed for use with continuous mining machines of the type wherein the cutting drum is mounted on the front end of the machine is disclosed in U.S. Pat. No. 4,380,353 to Campbell et al. That patent discloses a dust control system that includes a series of interconnected ducts with the intakes thereof being located adjacent the cutting drum. A fan is attached to one end of the ductwork for drawing air therein and through a "flooded bed" scrubber. The scrubber comprises a bed formed from a plurality of open mesh material that is housed between reinforcing screens that are mounted in a portion of the ductwork system. A plurality of spray nozzles are mounted upstream of the bed for continuously spraying water thereon. As the dust particles pass through the wet bed, the dust is entrained in droplets of water. A demister, in the form of a collection of louvers, is provided between the bed and the fan and serves to separate the entrained dust particles from the air stream and direct those entrained particles into a sump located therebelow. A pump is provided to pump the dust laden water that collects in the sump to a place of disposal.

While this particular scrubber and ductwork arrangement is adapted for use in connection with continuous mining machines of the type disclosed in the Campbell et al. patent, it is not well-suited for use in connection with longwall shearers, due to the dual cutting drum arrangement and the ventilation air flow that is normally present around the shearer. In particular, in most longwall mining arrangements, it is standard practice to direct ventilation air at relatively high velocities along the longwall face. This air flow tends to circulate around the ends of the shearer and serves to disperse the dust that is generated by the cutting drums in the areas wherein the operating personnel are located. The dust control system disclosed in the Campbell et al. patent is not well adapted for filtering dust laden air from opposite ends of the machine due to the ductwork configuration employed therein.

U.S. Pat. No. 5,219,208 to Liao et al. discloses a scrubber system for dispersing dust that is generated by longwall shearers. The system comprises a plurality of small scrubbing units that are mounted on top of the shearer. Each scrubbing unit contains a series of twin fluid atomizers located at the inlet of the unit to produce a fine mist of water for capturing respirable dust. The scrubbing units are positioned on the shearer such that they can draw the dust cloud from around the rotating drums of the shearer and direct the air containing the water mist and captured dust toward the longwall face. A spray bar equipped with five twin fluid atomizers is mounted adjacent to one of the cutting drums for redirecting dust laden air toward the face. Each of the scrubbing units have fabrication, installation and maintenance costs associated therewith making such system less practical for some shearer configurations. In addition, such dust removal system of this type is somewhat less efficient than the flooded bed type scrubbers which provide a medium wherein the dust laden air and water can be forceably mixed. Thus, there is a need for a dust control system for use with a longwall shearer that is relatively inexpensive to fabricate, install and maintain. There is a further need for a dust control system that can efficiently remove airborne dust from around those portions of the shearer wherein the operating personnel are typically located.

The subject invention is directed toward an improved apparatus for removing dust created during mining by a longwall shearer which addresses, among others, the above-discussed needs and provides a dust control apparatus which is effective in preventing dust flow in operator areas and removing dust particles from ventilation air.

SUMMARY OF THE INVENTION

In accordance with a preferred form of the present invention, there is provided an apparatus for substantially removing dust created during mining by a mining machine, which has an elongated mobile frame and a laterally extending rotating drum at each end thereof for shearing material to be won from a mine face, from air moving along the mine face. The apparatus includes a housing duct that is attached to the mobile frame between the rotating drums. The housing duct has an air inlet and outlet and is attached to the mobile frame such that the air outlet is adjacent to the side of the frame that faces the mine face. A screen member is attached within the housing between the air inlet and outlet and an air flow inducing member is attached to the mobile frame for inducing dust laden air to flow into the housing and through the screen member. At least one air deflection member is attached to the mobile frame for deflecting dust laden air into the inlet of the housing. At least one spray member is provided within the housing for spraying a liquid from a liquid source onto the screen member such that when the dust laden air passes therethrough, the dust is substantially entrained in the liquid and discharged through the outlet by the air inducing means.

It is therefore an object of the present invention to provide an apparatus that can be mounted between the cutting drums of a longwall shearer for effectively collecting and redirecting dust generated during the mining process.

It is another object of the present invention to provide an apparatus having the above-mentioned attributes that is relatively inexpensive to fabricate, install and maintain.

Accordingly, the present invention provides solutions to the aforementioned problems associated with other dust collecting and scrubbing apparatuses used in connection with longwall shearers. The reader will appreciate that these and other details, objects and advantages will become apparent as the following detailed description of the present preferred embodiments thereof proceeds.

BRIEF DESCRIPTION OF THE DRAWINGS

In the accompanying drawings, there are shown preferred embodiments of the present invention wherein like reference numerals are employed to designate like parts and wherein.

DETAILED DESCRIPTION OF THE PREFERRED EMBODIMENTS

Figure 1:
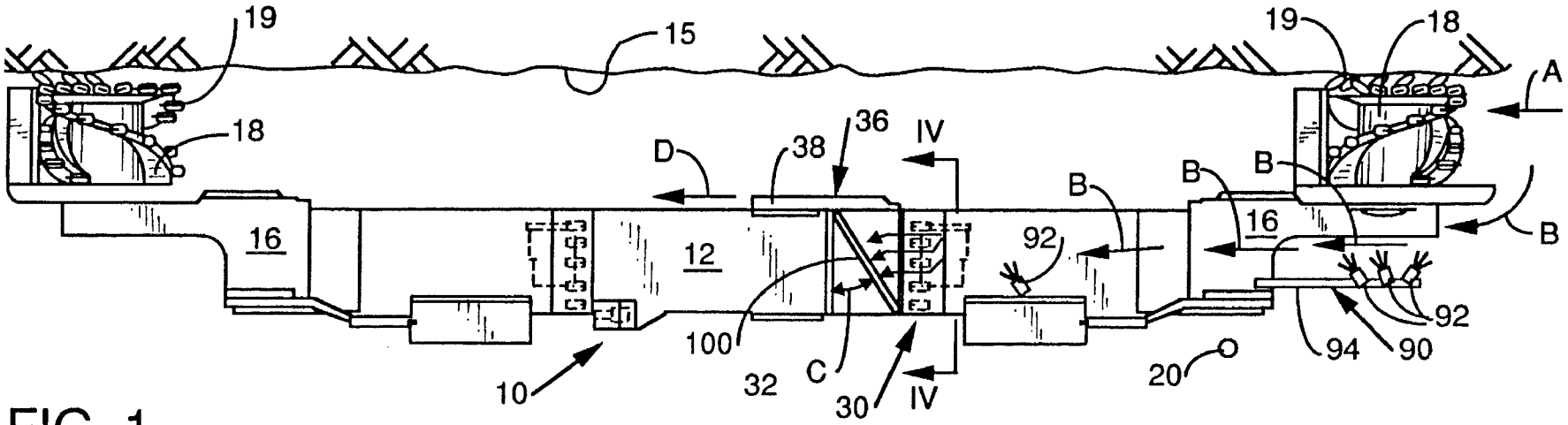
FIG. 1 is a plan view of a longwall shearer with a preferred dust collection apparatus of the present invention attached thereto.

Referring now to the drawings for the purposes of illustrating preferred embodiments of the invention only and not for purposes of limiting the same, the Figures show a dust collection system generally designated as 30 attached to a longwall shearer mining machine 10. More particularly and with reference to FIGS. 1 and 2, the shearer 10 has an elongated mobile frame 12 that is movably supported on a conveyor/trackway 14 that is substantially parallel with the longwall face 15. A laterally extending rotary drum 18 which has a plurality of mining bits 19 attached thereto is pivotally attached to each end of the elongated mobile frame 12 by a corresponding boom member 16. The operation of the shearer 10 is well known in the mining art and, as such, will not be discussed in detail herein. However, the skilled artisan will appreciate that the shearer 10 is moved back and forth on the trackway 14 such that the mining bits 19 on the rotating drums 18 can be brought into engagement with the mine face 15 to dislodge material therefrom. As the face recedes, the trackway 14 and shearer 10 are advanced towards the face 15 to enable the mining process to be continued. The operating personnel, generally represented by 20, are typically located at one end of the shearer as illustrated in FIG. 1.

A preferred embodiment of the present dust collection apparatus 30 comprises a duct housing 32 that is attached to the mobile frame 12 of the shearer 10 between the rotating drums 18. Preferably, the duct housing 32 is an integral part of the mobile frame 12. However, the duct housing 32 may also be prefabricated and attached to the mobile frame 12 in a predetermined location between the cutting drums 18.

Figure 3:
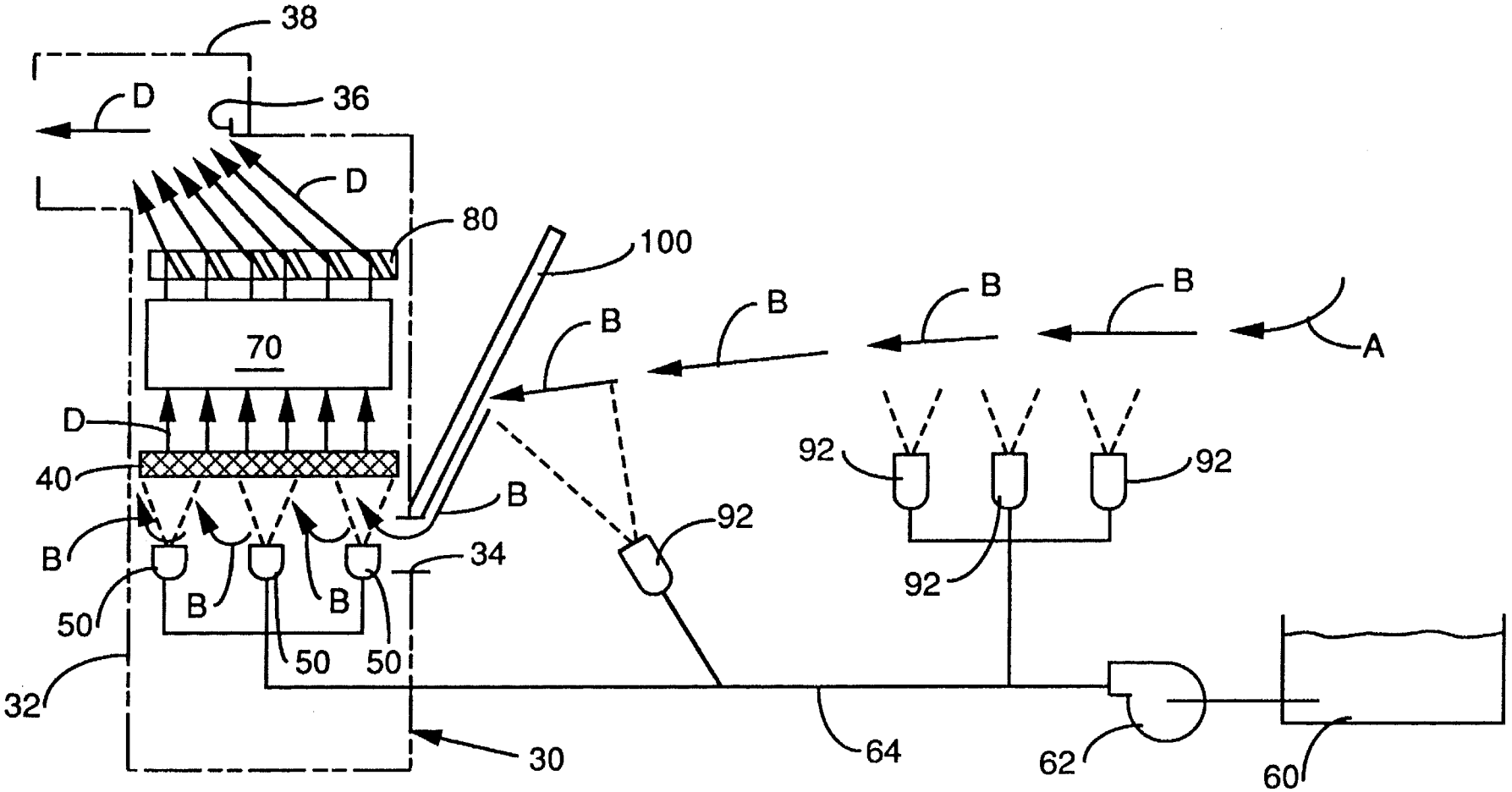
FIG. 3 is a schematic depiction of the dust collection apparatus of FIGS. 1 and 2.
Figure 4:
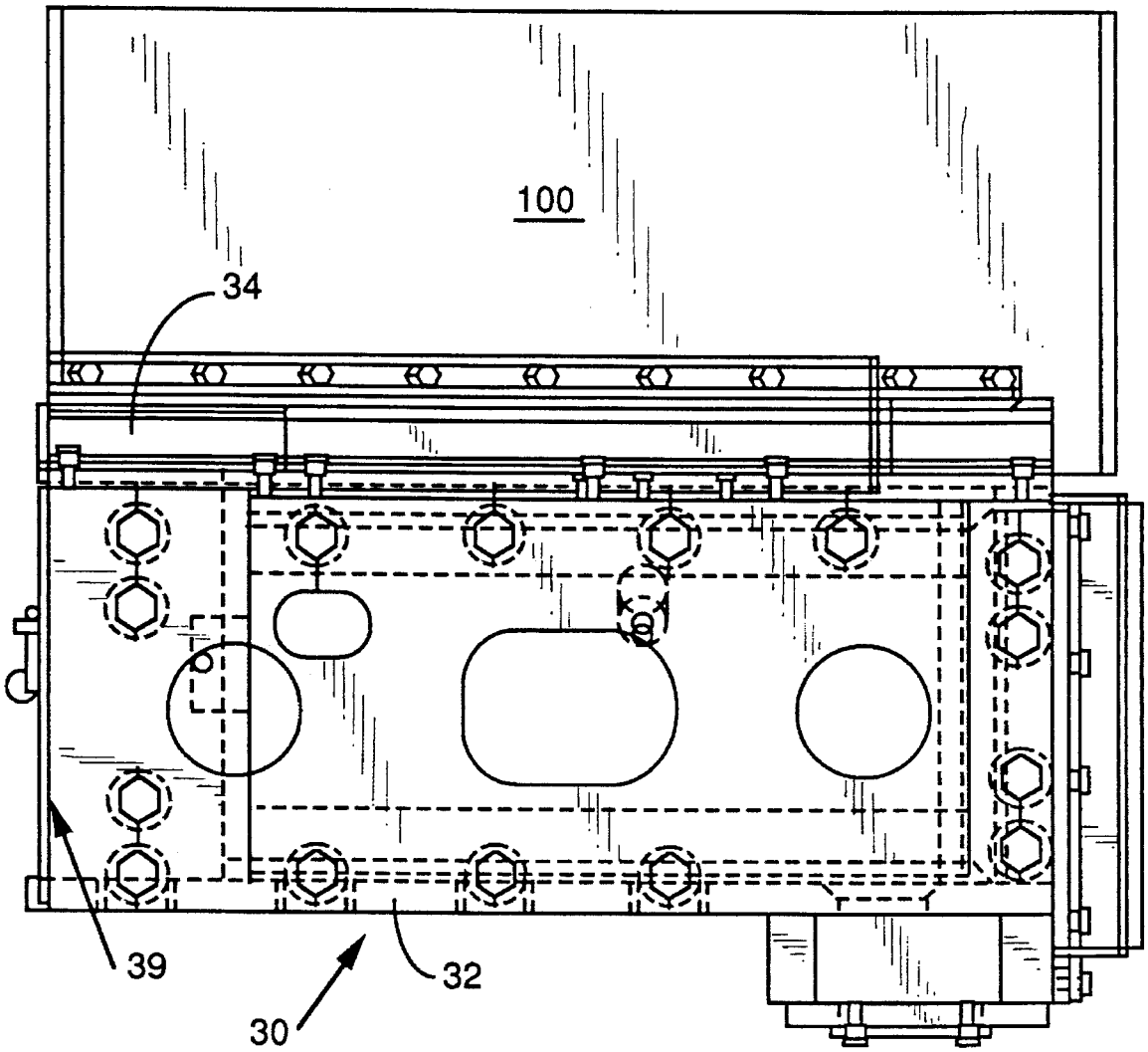
FIG. 4 is an end view of a preferred dust collection apparatus of the present invention taken along line IV—IV in FIG. 1.
Figure 5:
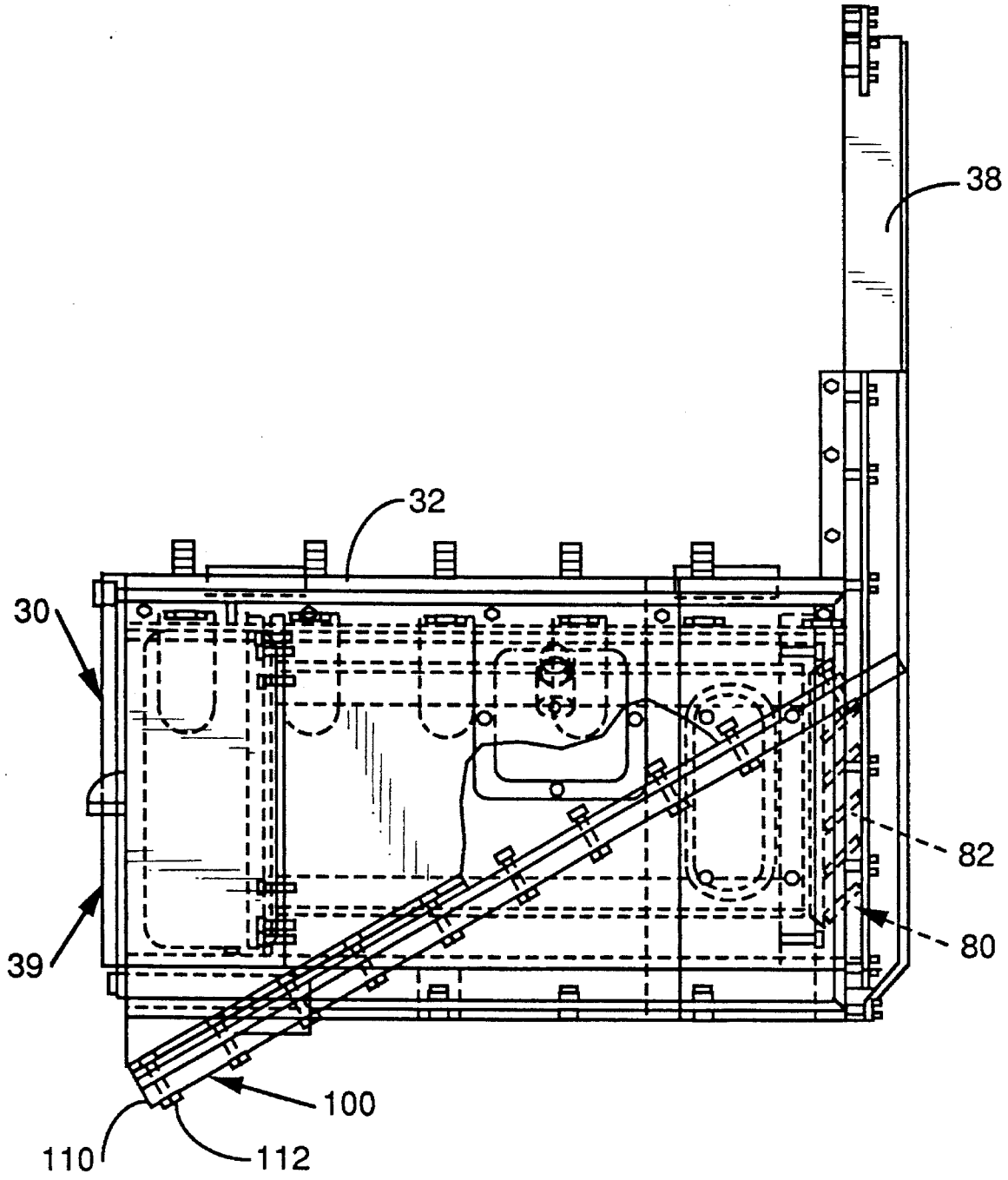
FIG. 5 is a plan view of the dust collection apparatus of FIG. 4.
Figure 6:
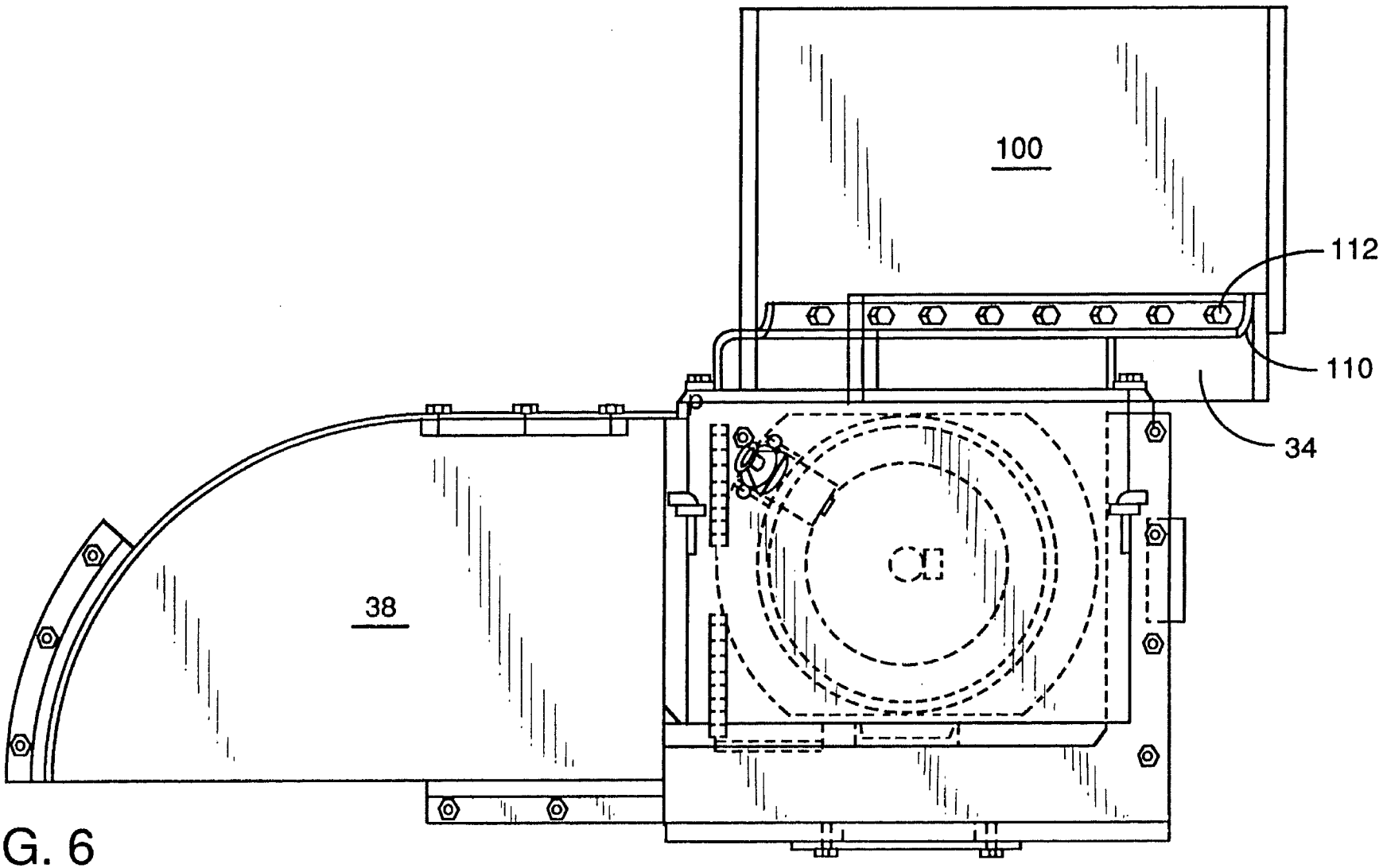
FIG. 6 is a right side elevational view of the dust collection apparatus of FIGS. 4 and 5.

As can be seen in FIGS. 3, 4, and 6, the duct housing 32 has an inlet 34 and an outlet 36. In a preferred embodiment, an inlet baffle (not shown) is positioned over the inlet 34 to prevent large pieces of material, which could damage various components of the collection apparatus 30, from being drawn into the duct housing 32. Preferably, such inlet baffle is fabricated from expanded metal having openings therein of sufficient size so as to not substantially restrict the amount of airflow permitted to pass into the duct housing 32.

A screen member 40 is housed within the duct housing 32 between the inlet 34 and the outlet 36 and preferably comprises ten layers of pleated urethane filter material supported in a frame. We prefer to use the urethane filter material of the type manufactured by the Donaldson Company, Inc. of Pittsburgh, Penna. under Part No. SK39932. It has been found that such screen construction provides for the collection of airborne dust particles such that when the dust particles are impacted with a liquid such as water, they become entrained in water droplets. The skilled artisan will appreciate, however, that other types and quantities of filter medium may also be used. The screen member 40 is preferably constructed such that it can be removably attached to the duct housing 32. Access to the screen member 40 can be easily gained through a sealed access door 39 located on the operator's side of the shearer 10 so that, should the screen member 40 become clogged with entrained dust particles, it can be quickly removed and cleaned. Preferably, the access door 39 is hinged to the duct housing 32; however, other attachment arrangements may be successfully employed.

A plurality of (preferably three) of spray nozzles 50 are arranged within the duct housing 321 for spraying a liquid (preferably water) onto the screen member 40. See FIG. 3. In a preferred embodiment, the spray nozzles 50, manufactured by Spray Systems, Inc. of Cincinnati, Ohio under Model No. ½ HH-35W, are used. Those of ordinary skill in the art will appreciate, however, that other types and quantities of spray nozzles may also be successfully employed. As can be seen in FIG. 3, water is pumped from a reservoir 60 by a pump 62 through line 64 to the spray nozzles 50. The amount of water that is sprayed onto the screen member 40 is related to the rate of airflow therethrough such that the majority of dust particles passing through the screen member 40 become entrained in water droplets. Acceptable scrubbing efficiencies have been achieved when water is sprayed onto the screen member 40 at a rate of approximately one gallon per one thousand CFM of air passing through the screen member 40.

The dust laden air is drawn through the screen member 40 by an air inducing fan 70 that is housed within the duct housing 32. In a preferred embodiment, an axial fan rated for 4,000–5,000 CFM, such as the one manufactured by the Fan Division of Joy Technologies, Inc. under Model No. 525255-6, is used; however, other sizes and types of fans may also be successfully employed. The skilled artisan will appreciate that the fan 70 is arranged within the housing duct 32 so as to cause air to flow into the housing duct 32 through the inlet 34 and pass through the screen member 40 at a desired rate.

Figure 7:
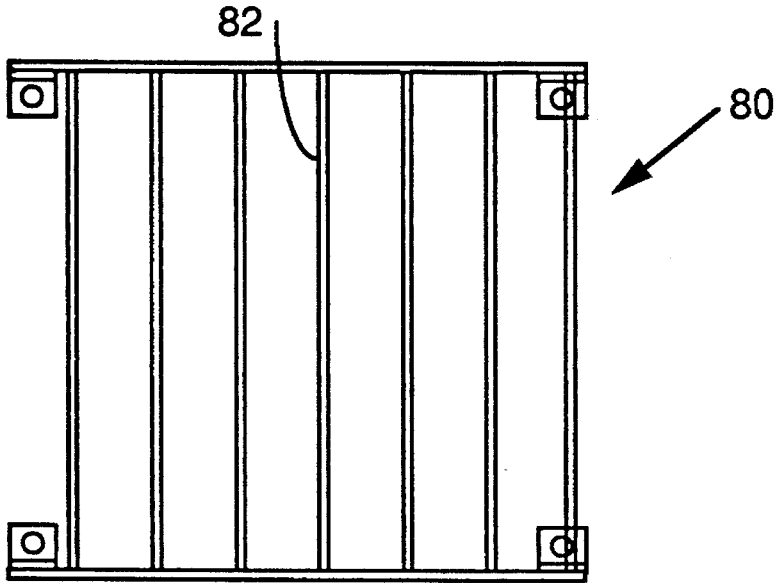
FIG. 7 is a front elevational view of a preferred baffle of the present invention.
Figure 8:
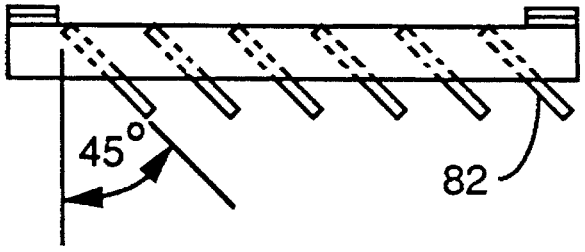
FIG. 8 is a plan view of the baffle of FIG. 7.

In a preferred embodiment, a baffle assembly 80 is attached to the duct housing 32 adjacent the discharge end of the fan 70. The baffle assembly 80 comprises a plurality of (preferably six) vanes 82 that are spaced approximately 2.75 inches apart and are each arranged at a 45 degree angle with respect to the direction of air flow passing therethrough. See FIGS. 7 and 8. However, other baffle constructions may also be employed. As will be discussed in further detail below, the baffle assembly 80 has vanes 82 therein that serve to direct the air stream carrying the smaller water entrained dust particles that is exiting the fan member 70 through the outlet 36 and exit duct 38.

As was mentioned above, it is standard practice in most longwall mining operations to blow ventilation air along the mine face 15 at a relatively high velocity. For illustrative purposes, arrow "A" represents the ventilation air that is being blown from right to left in FIGS. 1 and 2 along the mine face 15. As the air "A" enters the area around the cutting drum 18 adjacent the operator 20, it becomes laden with dust particles created as that drum 18 dislodges material from the mine face 15. The arrows designated as "B" represent that dust laden air. To assist the flow of dust laden air B into the inlet 34 of duct housing 32, additional air flow deflection apparatus is preferably employed. In particular, a spray boom assembly 90 is attached to the boom 16 supporting the right-most cutting drum 18 adjacent to the operator 20. Preferably, the spray boom assembly 90 comprises a plurality (preferably three) venturi spray nozzles 92 supported on a support member 94 that is attached to the boom 16. We prefer to use those venturi spray nozzles fabricated by Conflow of Washington, Pennsylvania, which spray water at a preferred rate of approximately 3 GPM at approximately 300 PSI; however, other venturi spray arrangements can also be successfully used. Also, at least one additional set of venturi spray nozzles 92 are preferably attached to the top of the mobile frame 12 between the spray boom assembly and the inlet 34 of the duct housing 32 to further assist the flow of the dust laden air "B" along the face 15 and into the inlet 34. As can be seen in FIG. 3, pump 62 also pumps water to venturi spray nozzles 92 through line 64.

In a preferred embodiment, a barrier or sail 100 is attached to the top of the mobile frame 12 such that it is disposed at an angle "C" (preferably 30–40 degrees) which is substantially transverse to the flow of the dust laden air "B". See FIG. 1. The skilled artisan will also appreciate that sail 100 is so positioned relative to the inlet 34 of duct housing 32 such that when the dust laden air "B" contacts the sail 100, the dust laden air "B" will be drawn into the duct housing 32 through the inlet 34 by the fan 70. In a preferred embodiment, the sail 100 is approximately 54"× 21" and is fabricated from flexible Neoprene. The sail 100 is attached to the mobile frame 12 by a mounting bar 110 and corresponding capscrews 112. It will be appreciated that the sail 100, due to its flexible nature, can accommodate irregularities in the mine ceiling. It will be further appreciated, however, that other sails or a plurality of sails of various sizes, shapes and constructions may also be successfully used.

Figure 2:
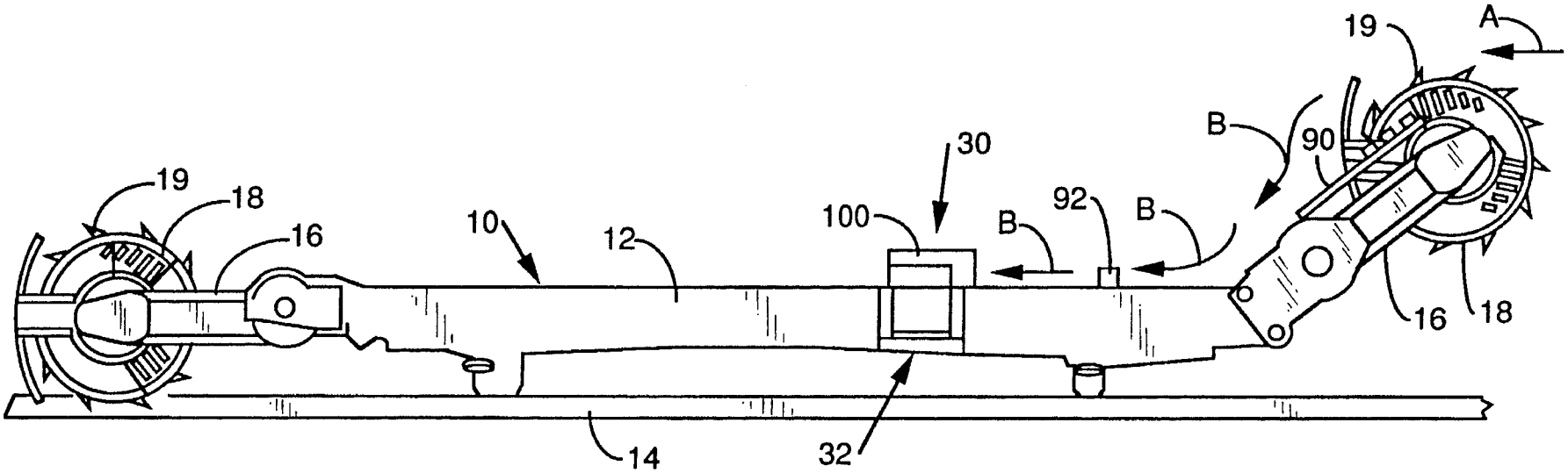
FIG. 2 is a side elevational view of the longwall shearer of FIG. 1.

The operation of the dust collection apparatus 30 may be understood from reference to FIGS. 1–3. In particular, clean ventilation air "A" is blown and directed from a remote source along the longwall face 15. As the air "A" enters the area around the cutting drum 18, it becomes laden with dust particles created during the mining process. The dust laden air "B" is contacted with the water sprays from the venturies 92 and is displaced toward the mine face 15 and the sail 100. As the dust laden air "B" contacts the sail 100, it is drawn in through the inlet 34 of the duct housing 32 by the fan 70. The dust laden air "B" then contacts the wetted screen member 40, causing the dust particles, by means of inertial impaction with the wet surfaces, to become entrained in water droplets. The larger entrained dust particles, in the form of a slurry, fall to the bottom of the duct housing 32. The slurry is removed from the duct housing 32 through the access door 39. It has been found that during typical longwall mining operations, the slurry need only be removed 1–2 times per eight hour shift. The smaller entrained dust particles and air stream mixture, generally represented by arrows "D" in FIG. 3, pass through the baffle assembly 80 which serves to direct that air and dust mixture through the outlet 36 and exit duct 38. The exit duct 38 is preferably arranged to discharge that air/liquid entrained dust mixture toward the mine floor adjacent to or along the face 15. In the alternative, the exit duct 38 may be arranged to discharge directly toward the mine face 15 and away from the operator 20.

As can be appreciated from the description above, the present invention addresses many of the dust control problems commonly encountered with longwall shears. The present invention is relatively inexpensive to install and maintain and serves to control the permeation of dust in the air located around the operator station of a longwall shearer mining machine. Those of ordinary skill in the art will, of course, appreciate that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for substantially removing dust created during mining by a mining machine, which has an elongated mobile frame and a laterally extending rotating drum at each end thereof for shearing material to be won from a mine face from air moving along a mine face, comprising:

a housing duct attached to said mobile frame between said rotating drums, said housing duct having an air inlet and outlet, said air outlet being adjacent the side of said frame facing the mine face;

screen means attached within said housing between said air inlet and said air outlet;

air flow inducing means attached to said mobile frame for inducing dust laden air to flow into said housing and through said screen means;

air deflection means including at least one upstanding barrier member attached to said mobile frame such that said barrier is disposed at an angle relative to said mobile frame which is substantially transverse to the direction of air flowing along the mine face for deflecting dust laden air into said inlet of said housing; and spray means within said housing for spraying a liquid from a liquid source onto said screen means such that when said dust laden air passes through said screen means, said dust is substantially entrained in said liquid and discharged through said outlet by said air inducing means.

2. The apparatus of claim 1 wherein each said upstanding barrier is fabricated from a rubber material.

3. 4. The apparatus of claim 1 further comprising at least one venturi spray member attached to said mobile frame for spraying said liquid from said liquid source into the dust laden air as the dust laden air flows along the mine face to thereby substantially direct the dust laden air toward said mine face and into said inlet of said housing.

4. The apparatus of claim 3 wherein at least one said venturi spray member is positioned adjacent to at least one said laterally extending rotating drum.

5. The apparatus of claim 1 wherein said air inducing means comprises a fan attached to said housing between said screen means and said outlet of said housing.

6. The apparatus of claim 1 wherein said spray means comprises a plurality of spray nozzles mounted within said housing and directed to spraying said liquid into contact with said screen means and said dust laden air as it passes therethrough.

7. The apparatus for claim 1 wherein said housing duct is an integral part of said elongated mobile frame.

8. Apparatus for substantially removing dust created during mining by a mining machine, which has an elongated mobile frame and a laterally extending rotating drum at each end thereof for shearing material to be won from a mine face from air moving along the mine face, comprising:

a housing duct integrally formed in said mobile frame between said rotating drums, said housing duct having an air inlet and outlet, said air outlet being adjacent the side of the frame facing the mine face;

a screen member attached within said housing between said air inlet and said air outlet;

a fan member attached to said mobile frame for inducing dust laden air to flow into said housing through said screen member;

an upstanding barrier attached to said mobile frame for deflecting dust laden air into said inlet of said housing duct;

a plurality of venturi spray members attached to said mobile frame external to said housing duct for spraying said liquid from said liquid source into the dust laden air as the dust laden air flows along the mine face to thereby substantially direct the dust laden air toward said mine face and into said air inlet of said housing duct, at least one said venturi spray member being adjacent to at least one said laterally extending rotating drum; and a plurality of spray nozzles mounted within said housing duct and directed to spraying said liquid into contact with said screen member and said dust laden air as it passes therethrough such that when said dust laden air passes through said screen member, said dust is substantially entrained in said liquid and is discharged through said air outlet by said fan member.

* * * * *